US008070427B2

(12) United States Patent
Snook et al.

(10) Patent No.: US 8,070,427 B2
(45) Date of Patent: Dec. 6, 2011

(54) GAS TURBINES HAVING FLEXIBLE CHORDAL HINGE SEALS

(75) Inventors: Daniel D. Snook, Moore, SC (US); Edward D. Benjamin, Simpsonville, SC (US); David J. Humanchuk, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 1070 days.

(21) Appl. No.: 11/933,371

(22) Filed: Oct. 31, 2007

(65) Prior Publication Data

US 2009/0110549 A1 Apr. 30, 2009

(51) Int. Cl.
*F01D 9/02* (2006.01)

(52) U.S. Cl. ..... 415/191; 415/209.3; 415/211.2; 415/213.1

(58) Field of Classification Search ..... 415/191, 415/199.5, 209.3, 211.2, 213.1
See application file for complete search history.

(56) References Cited

U.S. PATENT DOCUMENTS 3,909,155 A 9/1975 Whinfrey
4,194,869 A * 3/1980 Corcokios ..... 415/209.4
4,863,343 A * 9/1989 Smed ..... 415/138
5,839,878 A 11/1998 Maier
5,848,874 A * 12/1998 Heumann et al. ..... 415/189
6,164,656 A * 12/2000 Frost ..... 277/312
6,164,908 A * 12/2000 Nishida et al. ..... 415/173.7
6,595,745 B1 7/2003 Mohammed-Fakir

OTHER PUBLICATIONS

For the Developers of Massively Multiplayer Online Role Playing Games, See Turbine Inc. [Online reference: http://en.wikipedia.org/wiki/Turbine] Retrieved on Apr. 9, 2007.
"Turbine" [Online Reference: http://en.wikipedia.org/wiki/Turbine] Retrieved Apr. 9, 2007.

* cited by examiner

*Primary Examiner* — Ninh H Nguyen
(74) *Attorney, Agent, or Firm* — Cantor Colburn LLP

(57) ABSTRACT

Gas turbine systems having flexible chordal hinge seals are provided. According to an embodiment, a turbine system comprises: a nozzle segment comprising a stator vane extending between an inner band segment and an outer band segment; an inner support ring adjacent to the inner band segment; and an inner chordal hinge seal in operable communication with the nozzle segment, the inner chordal hinge seal comprising a flexible inner rail extending inwardly from the inner band segment, the inner rail having a projection for sealingly engaging the inner support ring.

18 Claims, 6 Drawing Sheets

GAS TURBINES HAVING FLEXIBLE CHORDAL HINGE SEALS

BACKGROUND

This disclosure relates generally to gas turbines and, more specifically, to flexible chordal hinge seals for sealing turbine nozzles within a gas turbine.

In a gas turbine, hot gases of combustion flow from combustors through first-stage nozzles and buckets and through the nozzles and buckets of follow-on turbine stages. The first-stage nozzles include an annular array or assemblage of cast nozzle segments, each including one or more nozzle stator vanes per segment. Each first-stage nozzle segment also includes inner and outer band portions spaced radially from one another. Upon assembly of the nozzle segments, the stator vanes are circumferentially spaced from one another to form an annular array between annular inner and outer bands. An outer shroud or retaining ring coupled to the outer band of the first-stage nozzles supports the first-stage nozzles in the gas flow path of the turbine. An annular inner support ring is engaged by the inner band and supports the first-stage nozzles against axial movement.

In an exemplary arrangement, forty-eight cast nozzle segments are provided with one vane per segment. The annular array of segments are sealed one to the other along adjoining circumferential edges by side seals. The side seals form a seal between high and low pressure regions by extending radially inwardly of the inner band and radially outwardly of the outer band. The high pressure region is found in the compressor discharge air, and the low pressure region is found in the hot gases of combustion of the hot gas flow path.

The nozzle segments also include inner and outer chordal hinge seals. The inner chordal hinge seals are used to seal between the inner band of the first-stage nozzles and an axially facing surface of the inner support ring. Each inner chordal hinge seal includes an inner rail extending radially inwardly from the inner band portion and a projection extending along the inner rail that runs linearly along a chord line of the inner band portion of each nozzle segment. This projection lies in sealing engagement with the axially opposite facing sealing surface of the inner support ring. The inner chordal hinge seals also act as hinges to allow the first-stage nozzles to move forward and aft as the inner support ring and the compressor discharge case undergo thermal expansion.

In addition, the outer sidewall chordal hinge seals are used to seal between the outer band of the first-stage nozzles and an axially facing surface of the outer shroud. Each outer chordal hinge seal includes an outer rail extending radially outwardly from the outer band portion and a projection extending along the outer rail that runs linearly along a chord line of the outer band portion of each nozzle segment. This projection lies in sealing engagement with the axially opposite facing sealing surface of the outer shroud. The outer chordal hinge seals also act as hinges to allow the first-stage nozzles to move forward and aft as the outer support ring or shroud and the compressor discharge case undergo thermal expansion.

During operation and/or repair of the first-stage nozzle, it has been found that both the outer and inner chordal hinge seals tend to experience warpage due to temperature differences across their rails. In particular, the seals tend to bow aft in the center and bow forward on the intersegment ends of the rails. Such warpage can cause gaps to form between the inner and outer chordal hinge seals and the respective sealing surfaces of the inner support ring and the outer shroud. These gaps can enable leakage of the compressor discharge cooling air into the hot gas flow path. This leakage can lead to problems such as increased production of NOx pollutants, hot gas ingestion past the chordal seals, and higher flowpath aero losses, which result in a lower heat rate.

Currently, supplemental seals are employed at the interface of the first-stage nozzles and the inner support ring/outer shroud to reduce the leakage flow past the chordal hinge seals. However, the use of such supplemental seals significantly adds to the complexity and cost of manufacturing gas turbines. A need therefore exists to develop a way of minimizing the leakage of fluid past the inner and outer sidewall chordal hinge seals without significantly increasing the cost and complexity of manufacturing gas turbines including such seals.

SUMMARY

Disclosed herein are gas turbine systems having flexible chordal hinge seals. According to an embodiment, a turbine system comprises: a nozzle segment comprising a stator vane extending between an inner band segment and an outer band segment; an inner support ring adjacent to the inner band segment; and an inner chordal hinge seal in operable communication with the nozzle segment, the inner chordal hinge seal comprising a flexible inner rail extending inwardly from the inner band segment, the inner rail having a projection for sealingly engaging the inner support ring.

In another embodiment, a turbine system comprises: a nozzle segment comprising a stator vane extending between inner and outer band segments; an outer shroud adjacent to the outer band segment; and an outer chordal hinge seal in operable communication with the nozzle segment; the outer chordal hinge seal comprising a flexible outer rail extending outwardly from the outer band segment, the outer rail having a projection for sealingly engaging the outer shroud.

BRIEF DESCRIPTION OF THE DRAWINGS

Referring now to the Figures, which are exemplary embodiments, and wherein the like elements are numbered alike.

DETAILED DESCRIPTION

Figure 1:
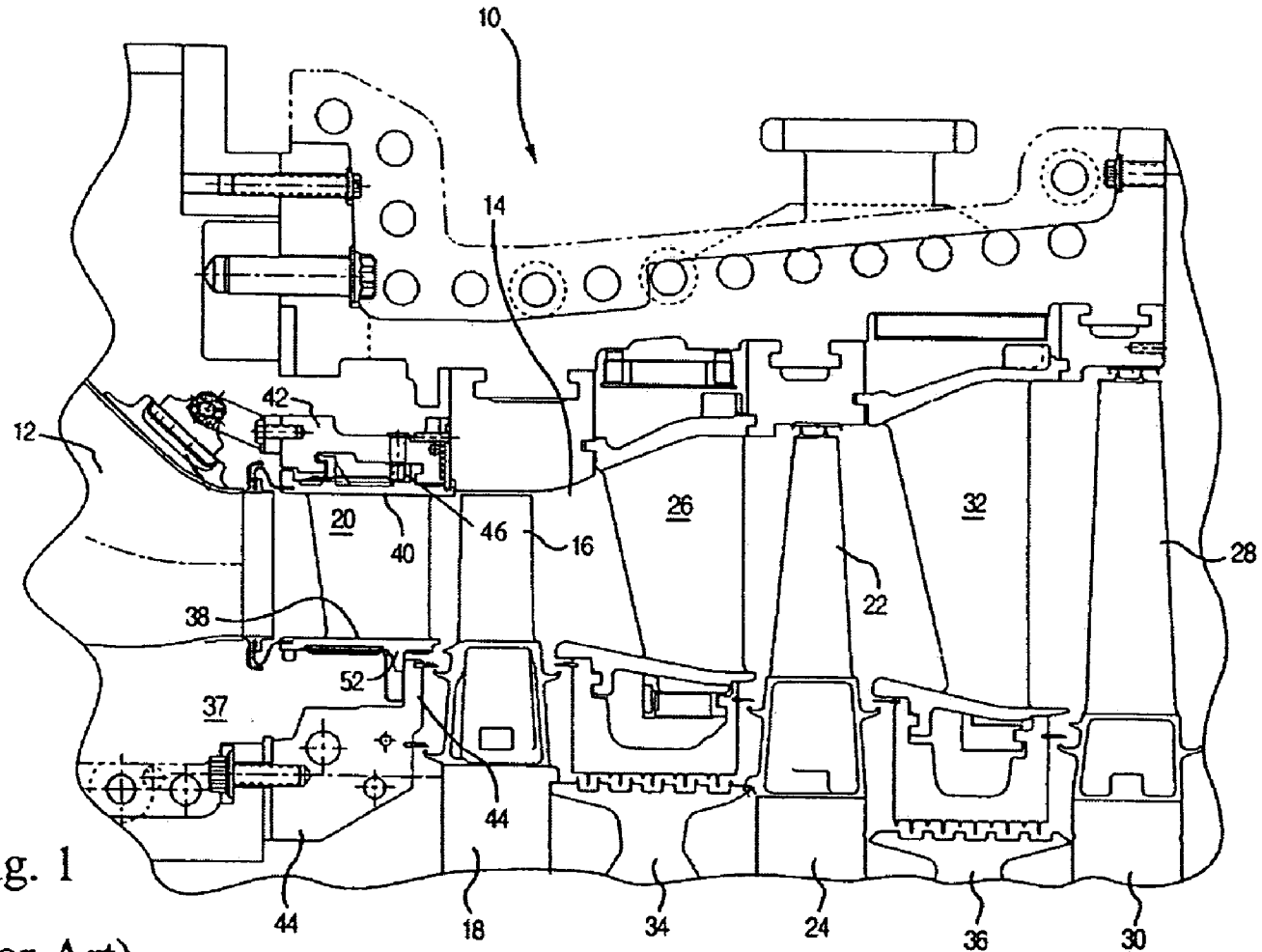
Fig. 1 (Prior Art)
FIG. 1 is a schematic elevational view of a section of a gas turbine.

Turning to FIG. 1, an exemplary embodiment of a section of a gas turbine 10 is shown. Turbine 10 receives hot gases of combustion from an annular array of combustors (not shown), which transmit the hot gases through a transition piece 12 for flow along an annular hot gas path 14. Turbine stages are disposed along the hot gas path 14. Each stage comprises a plurality of circumferentially spaced buckets mounted on and forming part of the turbine rotor and a plurality of circumferentially spaced stator vanes forming an annular array of nozzles. For example, the first stage includes a plurality of circumferentially-spaced buckets 16 mounted on a first-stage rotor wheel 18 and a plurality of circumferentially-spaced stator vanes 20. Similarly, the second stage includes a plurality of buckets 22 mounted on a second-stage rotor wheel 24 and a plurality of circumferentially-spaced stator vanes 26.

Moreover, the third stage includes a plurality of circumferentially-spaced buckets 28 mounted on a third-stage rotor wheel 30 and a plurality of circumferentially-spaced stator vanes 32. Additional stages can be present if needed. The stator vanes 20, 26, and 32 are mounted to a turbine casing, while the buckets 16, 22, and 28 and wheels 18, 24, and 30 form part of the turbine rotor. Between the rotor wheels are spacers 34 and 36, which also form part of the turbine rotor. It will be appreciated that compressor discharge air is located in a region 37 disposed radially inwardly and radially outwardly of the first stage and that such air in region 37 is at a higher pressure than the pressure of the hot gases flowing along the hot gas path 14. As used herein, "radially inwardly" is defined as extending in a radial direction toward a center axis of the turbine defined by a turbine shaft, and "radially outwardly" is defined as extending in a radial direction away from the center axis of the turbine Referring to the first stage of the turbine 10, the first-stage nozzles include nozzle segments and stator vanes arranged in an annular array of stator segments disposed between inner and outer bands, respectively, which are supported from the turbine casing (not shown). Thus, each nozzle segment includes one or more stator vanes 20 that extend between inner and outer band segments 38 and 40, respectively. An outer shroud 42 for securing the first-stage nozzles is in operable communication with the turbine casing and the outer band segment 40. This outer shroud 42 includes an axially facing surface in axial opposition to a surface of the nozzle segment. The interface between these two surfaces includes a flexible or compliant outer chordal hinge seal. Likewise, an inner support ring 44 for securing the first-stage nozzle against axial movement is in operable communication with the inner band segment 38. The inner support ring 44 includes an axially facing surface in axial opposition of a surface of the nozzle segment. The interface between these two surfaces includes an inner chordal hinge seal 52. It is intended that when the turbine 10 is in operation, the outer and inner chordal hinge seals form seals between the high pressure compressor discharge air in the region 37 and the lower pressure hot gases flowing in the hot gas path 14.

Figure 2:
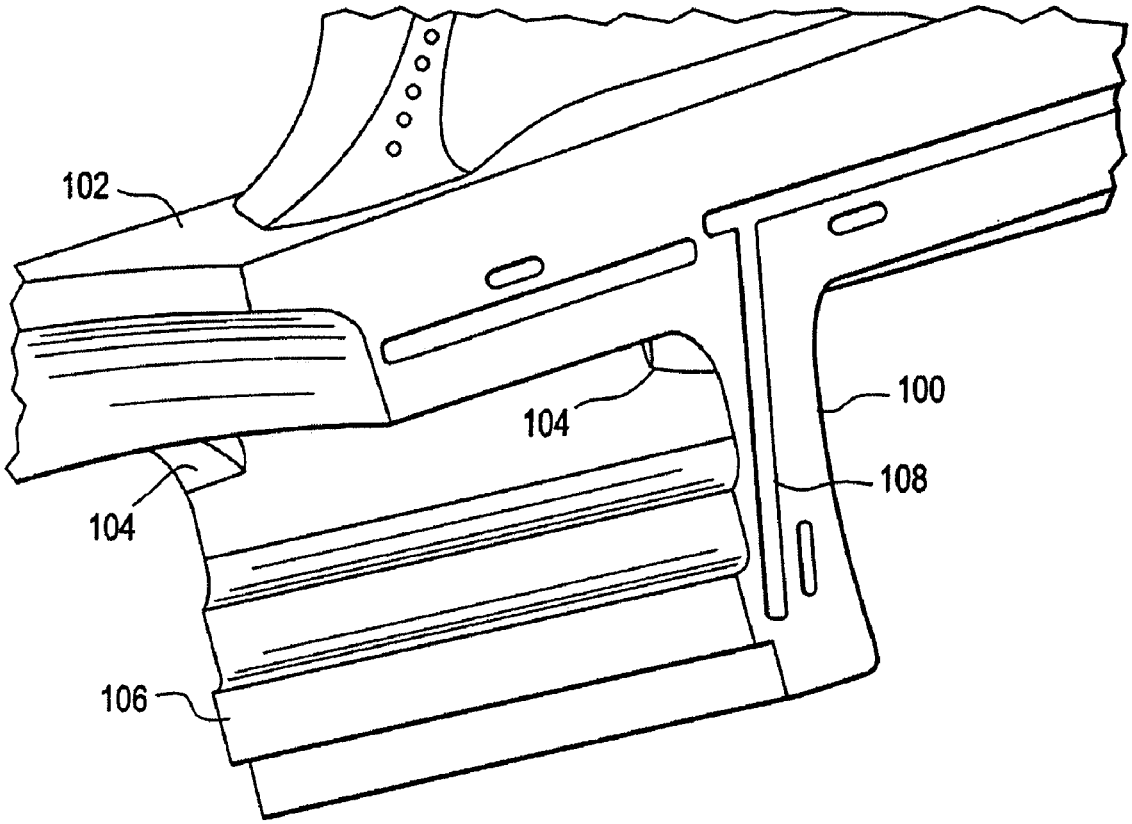
FIG. 2 is a schematic perspective view of a flexible chordal hinge seal for use in a gas turbine.
Figure 3:
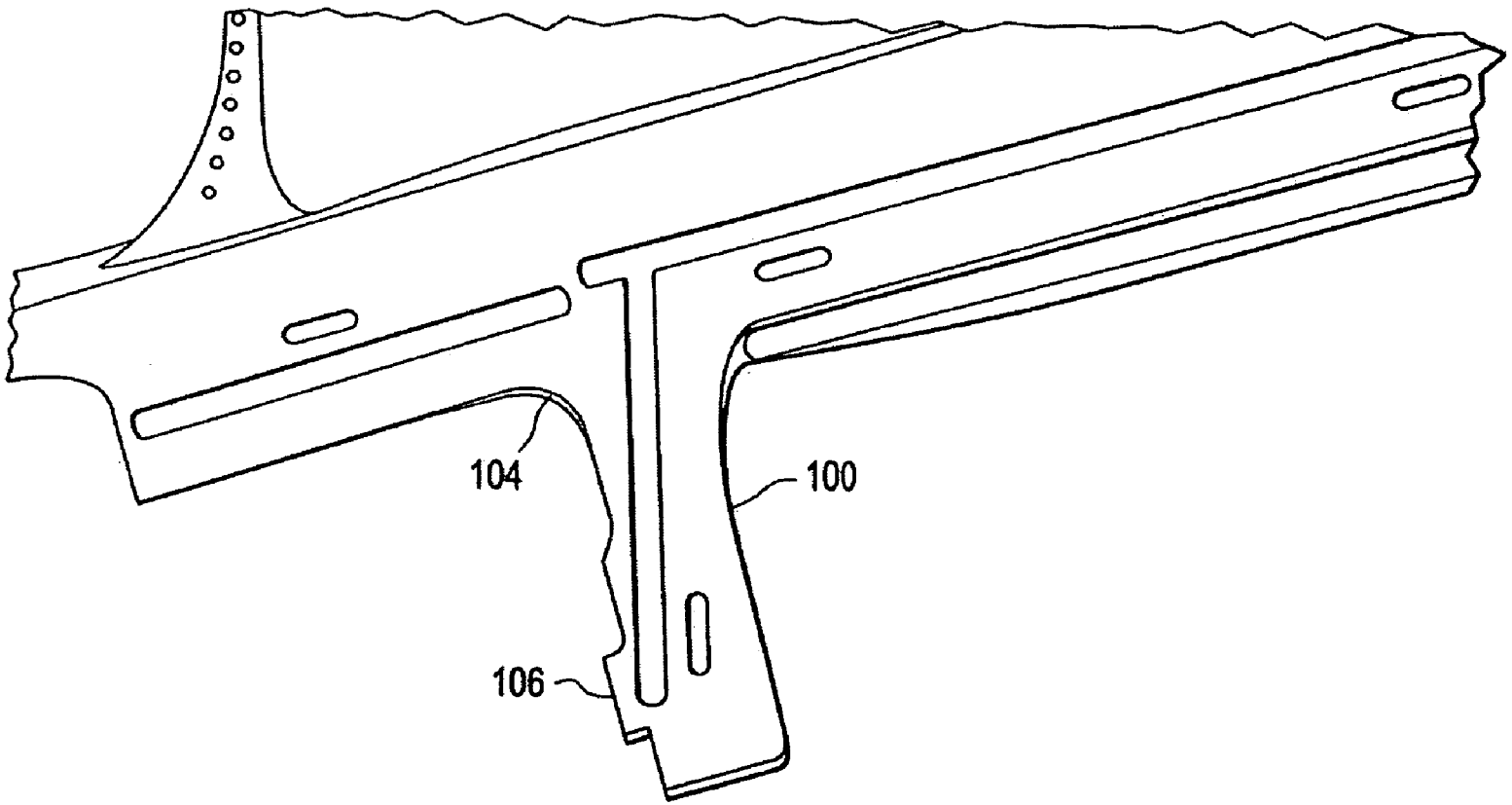
FIGS. 3-5 are perspective views from different angles of a flexible chordal hinge seal attached to a nozzle segment of a gas turbine in accordance with various embodiments.
Figure 4:
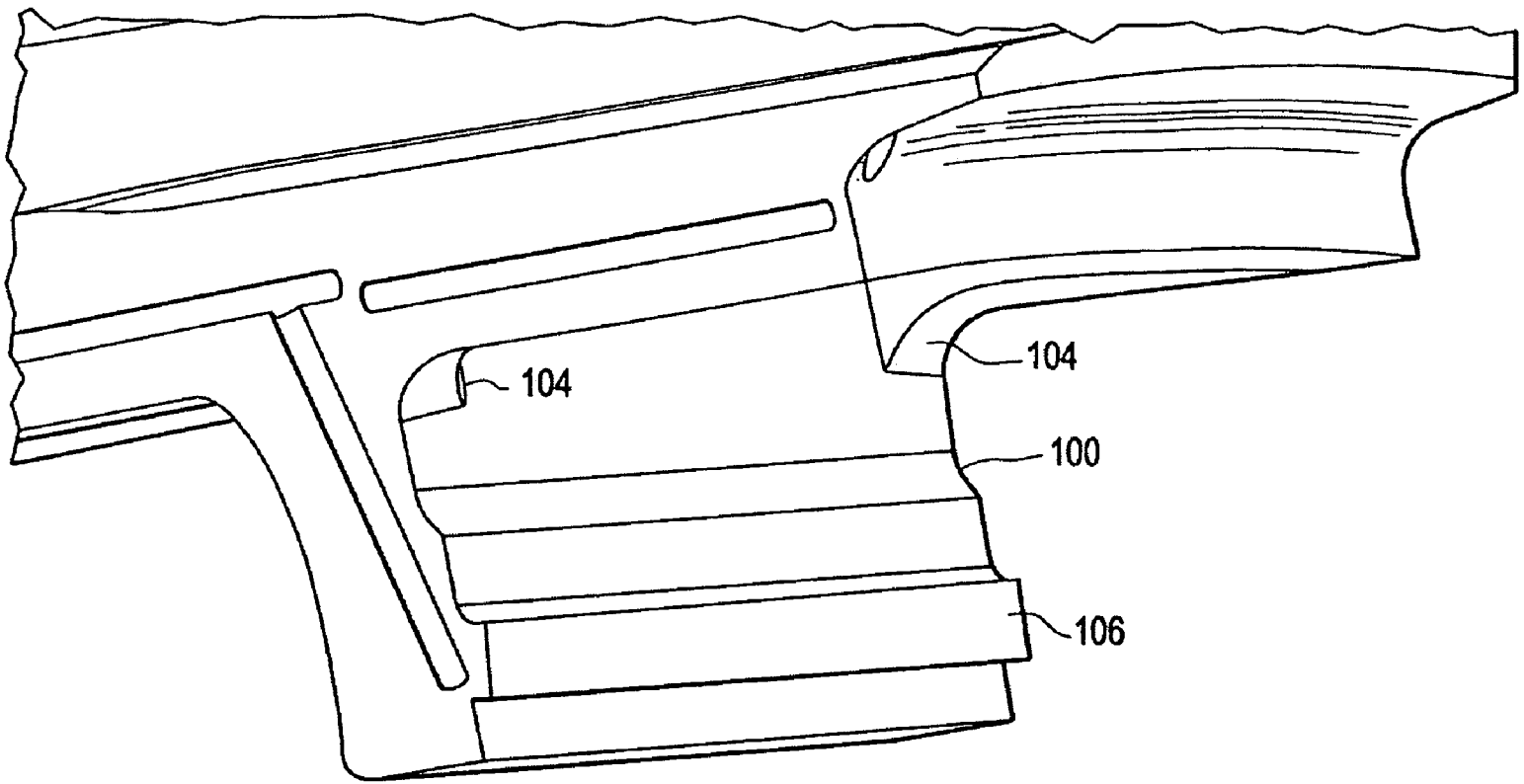

The inner and outer flexible chordal hinge seals have the same or similar designs. An exemplary embodiment of a chordal hinge seal that can serve as both the inner and the outer chordal hinge seal is illustrated in FIGS. 2-4, which are views of the chordal hinge seal from different angles. The chordal hinge seal includes a flexible rail 100 extending from a band segment 102. The thickness of the rail 100 is greatly reduced compared to that of prior art chordal hinge seal rails. In the case of the inner chordal hinge seal design, the inner rail extends inwardly from the inner band segment, whereas in the case of the outer chordal hinge seal design, the outer rail extends outwardly from the outer band segment. As used herein, "radially inwardly" is defined as extending in a radial direction toward a center axis of the turbine defined by a turbine shaft, and "radially outwardly" is defined as extending in a radial direction away from the center axis of the turbine. The rail 100 of the chordal hinge seal includes a chord-wise, linearly extending projection 106 for sealingly engaging with the retaining ring/inner support ring.

In order to minimize or prevent leakage flow from the high pressure region to the low pressure region of the hot gas path, the rail 100 is rendered flexible. As shown, the flexibility of rail 100 can be optimized by varying the fillet 104 radius of curvature across the rail 100. The fillets 104 near the intersegment ends of the rail are shaped to mate with intersegment ends of other rails. Thus, the rails can be formed into an annular array of rails. Each intersegment end of the rail 100 can have a seal slot 108 shaped to mate with a seal of the intersegment end of an adjacent rail in the annular array. As defined herein, a "fillet" is a material shaped to ease an interior corner. The fillets 104 are disposed in corners between the band segment 102 and the rail 100. The fillets 104, which are desirably concave in shape, can be formed by various methods such as by welding the fillets 104 into the junctures or cast molding the fillets 104 together with the rail 100 and the band segment 102.

Figure 5:
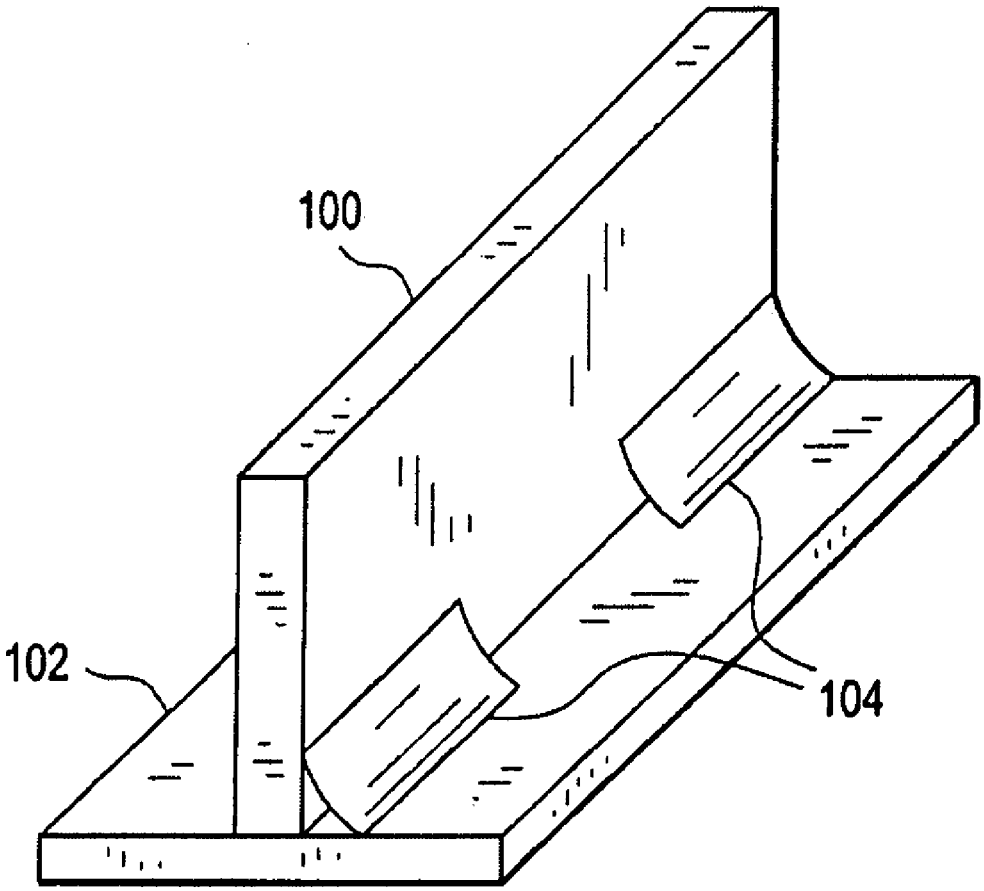

The fillets 104 can be used to vary the stiffness of the rail 100 along its length, thereby allowing mechanical loads to overcome thermal distortions across the rail 100 that can occur during the operation of the turbine. Due to the positioning of the fillets 104 near the ends of the rails, the juncture between the center of the rail 100 and the band segment 102 has a smaller radius of curvature than the juncture between the end of the rail 100 and the band segment 102. Moreover, the radius of curvature of each fillet 104 can increase as the fillet 104 approaches the end of the rail 100. This change in the radius of curvature along the rail 100 is used to maximize the flexibility of the rail 100 near its center where aft thermal bowing would otherwise be greatest and to minimize flexibility of the rail 100 near its ends where forward bowing would otherwise be greatest. Minimizing the flexibility of the rail 100 at its ends also allows the ends to seal against adjacent rails even under worst case tolerance conditions. Thus, an intersegment seal at the end of an adjacent rail would fit within the intersegment seal slot 108. FIG. 5 is a simple drawing that better illustrates the arrangement of the fillets 104 near the intersegment ends of the rail 100.

The flexibility of the chordal hinge seals is advantageously achieved without significantly adding to the complexity and cost of manufacturing the gas turbine. Due to this flexibility, more effective seals are formed between the high pressure compressor discharge region and the low pressure hot gas flow path. As a result, less leakage of gas past the seals can occur during operation of the turbine despite the presence of thermal variations across the seals. Consequently, aero losses in the hot gas flow path are reduced such that the heat rate of the turbine is improved, and lower quantities of NOx pollutants, e.g., NO and $NO_2$, are produced by the turbine. Hot gas ingestion past the seals is also reduced, resulting in durability improvements to the nozzle, shroud, and inner support ring.

Figure 6:
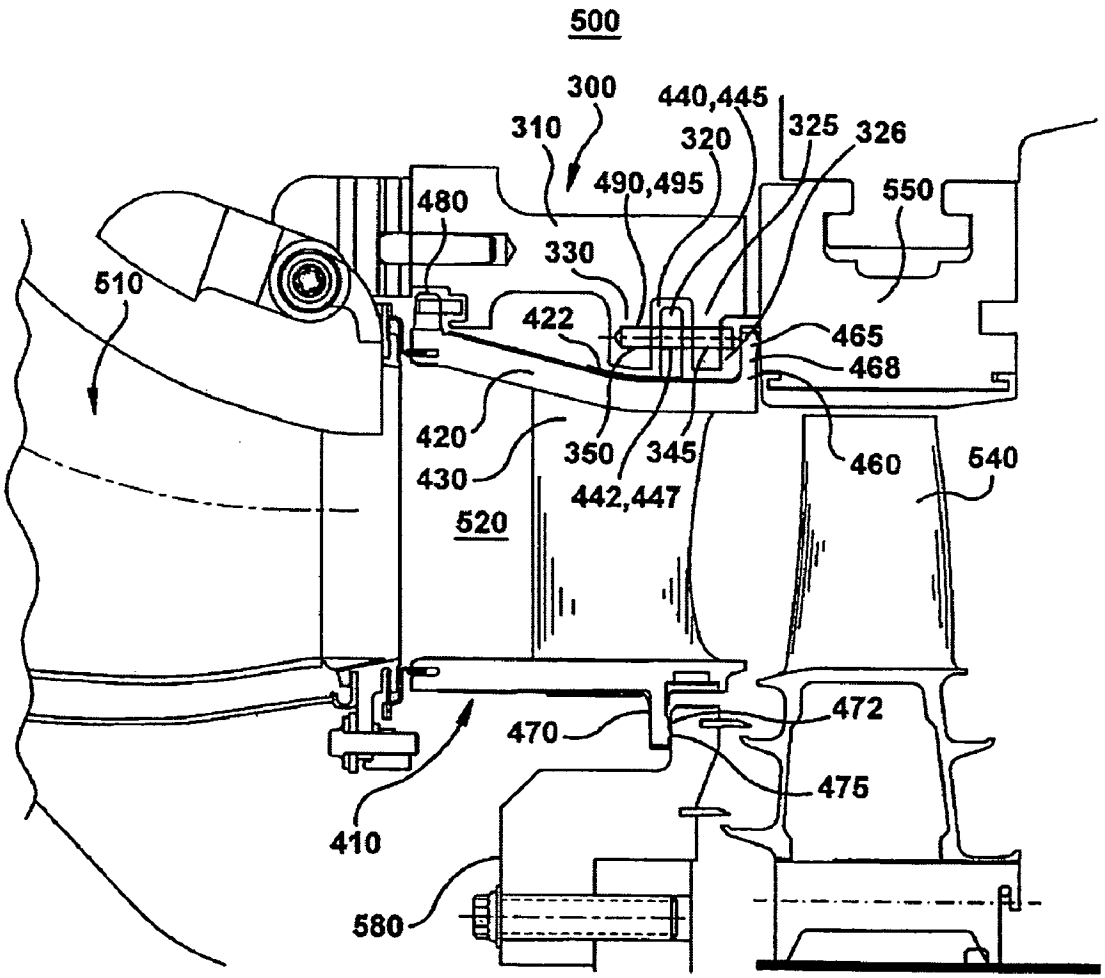
FIG. 6 is a schematic side elevational view of an embodiment of a section of a gas turbine that includes a first stage nozzle including the choral hinge seals described herein.

FIG. 6 depicts an exemplary embodiment of a section 500 of a gas turbine illustrating a first stage nozzle that includes the flexible chordal hinge seals described herein. Hot gases of combustion flow from a combustor (not shown) through transition piece 510. The hot gases enter the first stage nozzle 520, impinging on airfoil 430. The hot gases are directed by the airfoil 430 to the first stage bucket 540. The directing process performed by the nozzles also accelerates gas flow resulting in a static pressure reduction between inlet and outlet planes and high pressure loading of the nozzles. Retaining ring 300 includes forward circumferential land 330 and aft circumferential land 325. Retaining lugs 440, 445 (one shown) of the outer sidewall 420 for each first stage nozzle fit into annular groove 320. Retaining pins 490, 495 (one shown) fit through axial holes 345 and 350 in the aft retaining land 325 and the forward retaining land 330, respectively. The retaining pins 490, 495 provide radial and circumferential support for the first stage nozzle 520 through retaining lugs 440, 445. Chordal hinge rail 460 on the outer sidewall 420 provides axial support for the nozzle at the point of the chordal hinge seal 465 making contact with the shroud 550 for the first stage bucket 540. Chordal hinge rail 470 on the inner sidewall 410 provides axial support for the nozzle at the point of chordal hinge seal 475 making contact with the support ring 580.

Retaining pins 490, 495 are prevented from backing out from the retaining lugs 440, 445 by chordal hinge rail 460.

As used herein, the terms "a" and "an" do not denote a limitation of quantity, but rather denote the presence of at least one of the referenced items. Reference throughout the specification to "one embodiment", "another embodiment", "an embodiment", and so forth means that a particular element (e.g., feature, structure, and/or characteristic) described in connection with the embodiment is included in at least one embodiment described herein, and may or may not be present in other embodiments. In addition, it is to be understood that the described elements may be combined in any suitable manner in the various embodiments. Unless defined otherwise, technical and scientific terms used herein have the same meaning as is commonly understood by one of skill in the art to which this invention belongs.

While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. A turbine system comprising:

a nozzle segment comprising a stator vane extending between an inner band segment and an outer band segment;

an inner support ring adjacent to the inner band segment; and an inner chordal hinge seal in operable communication with the nozzle segment, the inner chordal hinge seal comprising a flexible inner rail extending inwardly from the inner band segment, the inner rail having a projection for sealingly engaging the inner support ring, wherein a first flexibility of the inner rail near a center of the inner rail is greater than a second flexibility of the inner rail near an end of the inner rail.

2. The turbine system of claim 1, wherein the inner support ring comprises an axially facing first surface and the nozzle segment comprises a second surface in axial opposition to the first surface, and wherein the inner chordal hinge seal forms a seal between the first surface of the inner support ring and the second surface of the nozzle segment.

3. The turbine system of claim 1, wherein the inner chordal hinge seal forms a seal between low and high pressure regions on opposite sides of the seal.

4. The turbine system of claim 1, wherein the inner chordal hinge seal comprises a fillet near each end of the inner rail in an area between the inner rail and the inner band segment of the nozzle segment.

5. The turbine system of claim 4, wherein the fillet is concave in shape.

6. The turbine system of claim 4, wherein a radius of curvature of the fillet increases as the fillet approaches the end of the inner rail.

7. The turbine system of claim 4, wherein the fillet is a molded fillet.

8. The turbine system of claim 4, wherein the fillet is a welded fillet.

9. The turbine system of claim 1, wherein a first juncture between a center region of the inner rail and the inner band segment of the nozzle segment has a smaller radius of curvature than a second juncture between an end region of the inner rail and the inner band segment of the nozzle segment.

10. The turbine system of claim 1, further comprising:

an outer shroud adjacent to the outer band; and an outer chordal hinge seal in operable communication with the nozzle segment, the outer chordal hinge seal comprising a flexible outer rail extending outwardly from the outer band, the outer rail having a second projection for forming a second seal between the nozzle segment and the outer shroud.

11. A turbine system comprising:

a nozzle segment comprising a stator vane extending between inner and outer band segments;

an outer shroud adjacent to the outer band segment; and an outer chordal hinge seal in operable communication with the nozzle segment, the outer chordal hinge seal comprising a flexible outer rail extending outwardly from the outer band segment, the outer rail having a projection for sealingly engaging the outer shroud, wherein a first flexibility of the outer rail near a center of the outer rail is greater than a second flexibility of the outer rail near an end of the outer rail.

12. The turbine system of claim 11, wherein the outer shroud comprises an axially facing first surface and the nozzle segment comprises a second surface in axial opposition to the first surface, and wherein the outer chordal hinge seal forms a seal between the first surface of the outer shroud and the second surface of the nozzle segment.

13. The turbine system of claim 11, wherein the outer chordal hinge seal forms a seal between low and high pressure regions on opposite sides of the seal.

14. The turbine system of claim 11, wherein the outer chordal hinge seal comprises a fillet near each end of the outer rail in an area between the outer rail and the outer band of the nozzle segment.

15. The turbine system of claim 14, wherein the fillet is concave in shape.

16. The turbine system of claim 14, wherein a radius of curvature of the fillet increases as the fillet approaches the end of the outer rail.

17. The turbine system of claim 14, wherein the fillet is a molded fillet or a welded fillet.

18. The turbine system of claim 11, wherein a first juncture between a center region of the outer rail and the outer band of the nozzle segment has a smaller radius of curvature than a second juncture between an end region of the outer rail and the outer band of the nozzle segment.

* * * * *